US007428790B2

(12) United States Patent
Pellerin

(10) Patent No.: US 7,428,790 B2
(45) Date of Patent: Sep. 30, 2008

(54) UNIVERSAL CLEAT

(75) Inventor: Daniel Pellerin, Varennes (CA)

(73) Assignee: Penquin Brands, Inc., Sharon Hill, PA (US)

( * ) Notice: Subject to any disclaimer, the term of this patent is extended or adjusted under 35 U.S.C. 154(b) by 0 days.

(21) Appl. No.: 09/771,416

(22) Filed: Jan. 26, 2001

(65) Prior Publication Data

US 2002/0100190 A1 Aug. 1, 2002

(51) Int. Cl.
*A43C 15/16* (2006.01)
*A43C 15/00* (2006.01)
*A43B 5/00* (2006.01)

(52) U.S. Cl. ..... 36/134; 36/126; 36/67 D; 36/62

(58) Field of Classification Search ..... 36/126, 36/134, 67 A, 67 O, 67 R, 59 R, 127, 128, 36/129, 130, 66, 61, 62
See application file for complete search history.

(56) References Cited

U.S. PATENT DOCUMENTS 1,055,229 A * 3/1913 Rogers ..... 36/64
1,923,365 A * 8/1933 Gaines ..... 36/126
2,006,637 A * 7/1935 Goldenberg ..... 36/59 R
3,029,529 A * 4/1962 Schwartz ..... 36/126
3,040,450 A * 6/1962 Phillips ..... 36/126
3,442,033 A * 5/1969 Hilburn, Jr. ..... 36/114
3,526,976 A * 9/1970 Jacobs ..... 36/100
3,597,863 A * 8/1971 Austin et al. ..... 36/59 R
3,812,605 A * 5/1974 Kaestle ..... 36/67 D
3,816,946 A * 6/1974 Davis et al. ..... 36/67 D
3,828,364 A * 8/1974 Aoyama ..... 36/67 B
4,523,396 A * 6/1985 Dassler ..... 36/134
4,590,693 A * 5/1986 Kawashima et al. ..... 36/126
5,058,292 A * 10/1991 Tanel ..... 36/126
D341,479 S 11/1993 Saito et al. ..... D2/314
5,628,129 A * 5/1997 Kilgore et al. ..... 36/134
D405,249 S 2/1999 Hikita et al. ..... D2/962
5,943,795 A * 8/1999 Ueda et al. ..... 36/131
6,018,893 A 2/2000 Workman ..... 36/134
6,041,461 A * 3/2000 Ogawa et al. ..... 12/146 R
D454,681 S * 3/2002 Duval ..... D2/962

OTHER PUBLICATIONS

Photographs of cleats by Nike, Easton, Adidas, and Reebok.

* cited by examiner

*Primary Examiner*—Jila M Mohandesi
(74) *Attorney, Agent, or Firm*—John J. Skinner, Jr.; Charles N. Quinn; Fox Rothschild LLP

(57) ABSTRACT

A universal cleat suitable for use for multiple different baseball shoes comprises a generally triangular base with a substantially flat bottom for fitting into a plurality of different shaped recesses in different shoes. There is a grip projecting from the base in a plane substantially perpendicular to the plane of the base. The base has an oblong shaped mounting hole for receiving a retaining screw.

8 Claims, 2 Drawing Sheets

UNIVERSAL CLEAT

CROSS-REFERENCE

This application is related to U.S. Design patent application Ser. No. 29/136,265, filed by Francois Duval, entitled CLEAT, which is filed on even date herewith, and which is incorporated herein by reference.

BACKGROUND

The present invention relates to cleats for athletic shoes, and particularly baseball cleats.

A problem for sporting goods retailers is that there are many different types of cleats. The cleats are typically removably mounted in a recess in the sole of a baseball shoe being held in place with a retaining screw that extends through a circular retainer hole in the cleat into a threaded opening in the recess. Manufacturers of baseball shoes, such as Nike, Easton, Adidas, and Reebok, each have their own proprietary cleat. These cleats differ in shape, sometimes have projections on the bottom, and have the retainer hole located in different places. Thus, the cleat of one manufacturer usually does not fit the shoe of a competitor.

This requires a retailer of baseball shoes to carry multiple different types of cleats. This creates inventory problems, and also leads to problems for the customer, because many times retailers do not have an adequate supply of the cleats from every manufacturer.

Attempts to carry just one type of cleat from one manufacturer have been unsuccessful because the cleats from one manufacturer generally do not fit into the recesses in the soles of the baseball shoes of another manufacturer. One reason for this is the belief that the cleats must snugly fit into the recess so that there is no wiggle, with the cleats retained firmly in place, even without the retaining screw.

Thus, from the retailer's and customers' standpoint, it would be desirable to have a universal cleat that could be used with the baseball shoes of multiple manufacturers.

SUMMARY

The preset invention is directed to a cleat that satisfies this need. A cleat according to the present invention is universal in that is suitable for use with multiple different types of shoes, such as baseball shoes, from different manufacturers. Such shoes have a recess in the sole for receiving a cleat. The recess has an opening therein for receiving a retaining screw to hold the cleat in place. The universal cleat comprises a generally triangular base with a substantially flat bottom for fitting in a plurality of different shaped recesses in different shoes. There is a grip projecting from the base in a plane substantially perpendicular to the plane of the base, and an oblong shaped mounting hole in the base for receiving the retaining screw.

Preferably the cleats are sized so that the perimeter of the base is smaller than the perimeter of the respective recess so that in the absence of the retaining screw, the cleat can wiggle in the recess. Preferably the length to the width of each mounting hole is from about 8:7 to about 10:7, and most preferably is about 9:7.

Surprisingly, it has been found that even though the cleats of the present invention have a flat bottom base, and thus no projections for engagement with the bottom of the shoe recesses, are sized to provide wiggle room, and use an oblong shaped hole instead of a circular hole, the cleats perform well in use. It has been found that the retaining screw itself sufficiently retains the cleat in place to give optimum performance to a baseball shoe, without all the other retention mechanisms provided by manufacturers. Thus, retailers and baseball players can maintain a supply of only a single type of cleat, namely, the universal cleat of the present invention, rather than maintaining an inventory of two or more different types of cleats.

DRAWINGS

These and other features, aspects and advantages of the present invention will become better understood from the following description, appended claims, and accompanying drawings where:

DESCRIPTION

Figure 1:
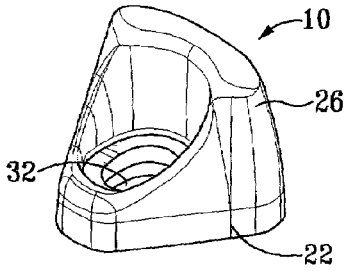
FIG. 1 is a perspective view of a cleat according to the present invention, with the cleat being upside down from its position when in use.
Figure 2:
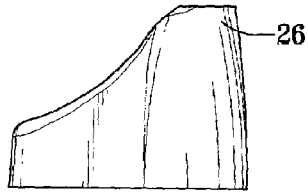
FIG. 2 is a side elevation view of the cleat of FIG. 1, where the side elevation view of the opposite side is a mirror image of FIG. 2.
Figure 3:
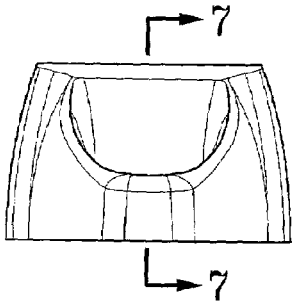
FIG. 3 is a front elevation view of the cleat of FIG. 1.
Figure 4:
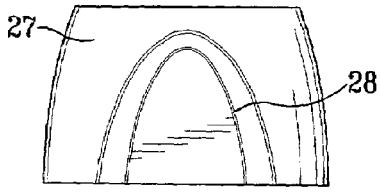
FIG. 4 is a rear elevation view of the cleat of FIG. 1.
Figure 5:
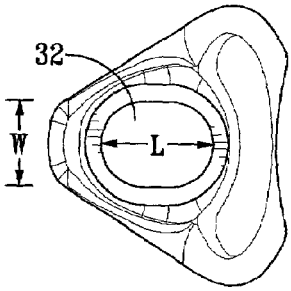
FIG. 5 is a top plan view of the cleat of FIG. 1.
Figure 6:
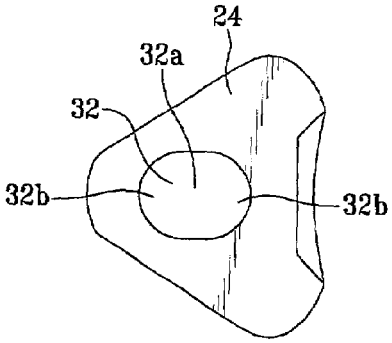
FIG. 6 is a bottom plan view of the cleat of FIG. 1.

With reference to FIGS. 1-11, a cleat 10 according to the present invention is useful with any of the baseball shoes 12A, 12B, 12C, and 12D shown in FIGS. 8-11, respectively. The particular shoes 12 shown in the drawings are baseball shoes, but it should be recognized that cleat 10 according to the present invention can be used with other types of athletic shoes.

As is typical with baseball shoes, there are a plurality of recesses 14 in the sole 16 of the shoe. The recesses 14A, 14B, 14C, and 14D of shoes 12A, 12B, 12C, and 12D, respectively, differ from each other. Because of this, a cleat that is specifically designed for each of the shoes does not fit in a recess of any of the other shoes. As shown in FIGS. 8-11, each recess is provided with a threaded opening 18 therein for holding a cleat in the recess by means of a threaded fastener 20.

More specifically, as shown in FIGS. 8-11, the manufacturers' shoes 12 have the common characteristic that the sole of each shoe 12 has at least one generally triangularly configured cleat mounting surface with a border defining a generally triangular recess 14 for receiving a cleat 10 with a threaded receptacle 18 positioned within generally triangular recess 14 for receiving a retaining screw to hold cleat 10 in place.

Figure 8:
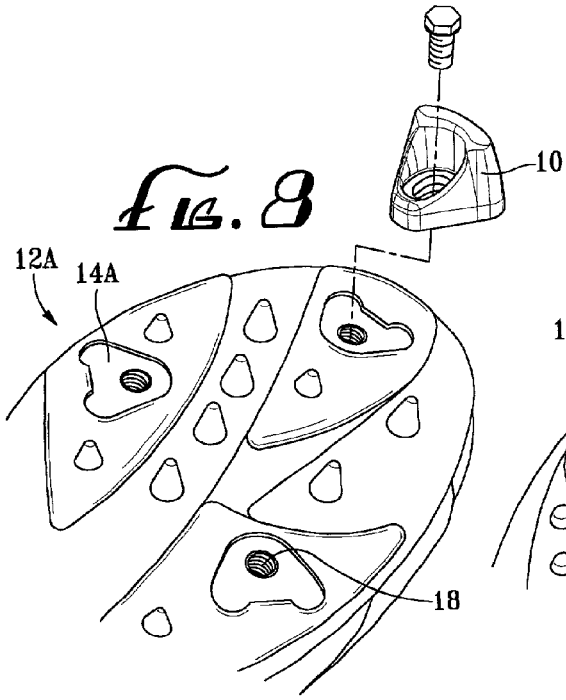
FIGS. 8-11 are perspective views of the recesses on the bottom of Reebok, Easton, Adidas, and Nike baseball shoes, respectively, for receiving a cleat.

As principally shown in FIG. 8, a first shoe 12*a*, provided by a first one of the manufacturers, includes a generally triangular recess 14*a* in the sole around threaded receptacle 18, sides of generally triangular recess 14*a* extending transversely from the sole with vertices of generally triangular recess 14*a* being rounded, two of the sides being straight and a third side having an inset inboard of a line which, if drawn, would connect two of the vertices in the same manner as to that of the straight sides.

Figure 9:
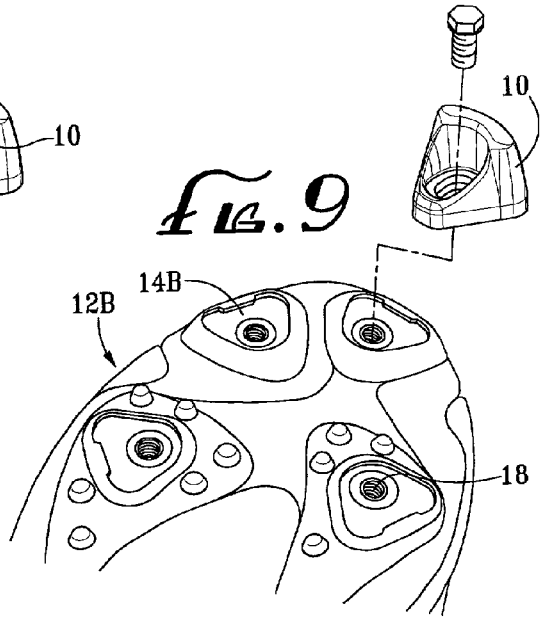

As shown in FIG. 9, a second shoe 12*b*, provided by a second one of the manufacturers, has a triangular shaped raised portion extending outwardly respecting the sole, with sides of the triangularly shaped raised portion sloping inwardly relative to the triangularly shaped raised portion with increasing distance from the sole. The vertices of generally triangular recess 14*b* are rounded. Two of the sides of generally triangular recess 14*b* are straight and a third side has an inset inboard of a line which, if drawn, would connect two of the vertices in the same manner as the straight sides. The triangularly shaped raised portion is positioned around threaded receptacle 18 formed in the sole, with threaded receptacle 18 between the center of the triangularly shaped raised portion and a vertex connecting the two straight sides.

Figure 10:
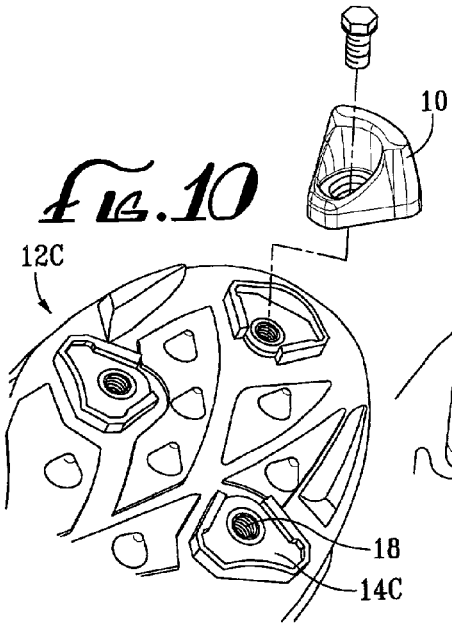

As shown in FIG. 10, a third shoe 12*c* provided by a third one of the manufacturers, has a generally triangular rib extending transversely from the sole and surrounding threaded receptacle 18. Generally triangular rib is open, the two ends of generally triangular rib stopping short of where one vertex of the generally triangular rib would be if the two sides of the generally triangular rib leading theretowards were extended to intersect. The two sides of the generally triangular rib are of equal length and are connected by a third side having a continuous arc swung from the top of the third side in a plane parallel to the third side and perpendicular to the sole. The generally triangular rib includes lips extending inwardly toward the center of the triangle and parallel with the sole from the tops of each of the two equal length sides, with edges of the lips bordering the two equal length sides of the triangular portion, and stopping short of vertices of said triangular rib.

Figure 11:
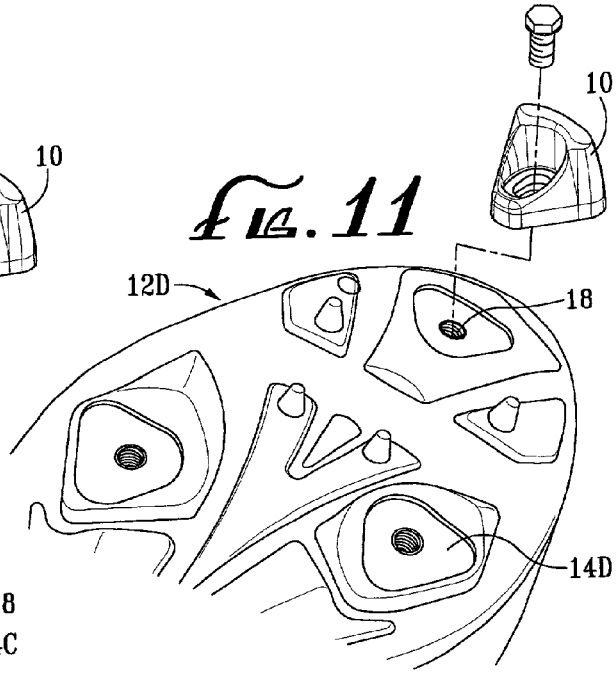

As shown in FIG. 11, a fourth shoe 12*d*, provided by a fourth one of the manufacturers, has a generally triangular recess 14*d* formed about threaded receptacle 18. Vertices of generally triangular recess 14*d* are rounded and sides of the recess are straight with two equal length sides being substantially the length of the straight sides of generally triangular recess 14*b* of second shoes 12*b*. The third side is longer than the equal length sides. The third side is straight.

The cleat 10 comprises a generally triangular base 22 with a flat bottom 24, and a grip 26 projects upwardly from the base 22 in a plane substantially perpendicular to the plane of the base 22. The grip 26 engages the turf. Because the bottom 24 of the base 22 is flat and the base 22 is triangular shaped, it can fit into different size recesses 14, including recesses that have indents for receiving grips extending from the base as in conventional cleats.

The grip 26 has a front face 27 with a cutout 28 therein. Only the bottom portion of the cutout 28 is required in the present invention, i.e., the portion of the cutout 28 that is at the level of the base 22. The remaining portion of the cutout 28 is for decorative purposes. The bottom portion of the cutout 28 is needed to accommodate retaining projections 30 that are present in some shoe recesses, such as those of FIGS. 8 and 9.

There is an oblong shaped mounting hole 32 in the base 22 for receiving the fastener 20. The mounting hole is oblong shaped to accommodate the fact that the mounting holes in the shoe shown in FIGS. 8-11 are not all in the same location relative to the periphery of the base 22. The ratio of the length "L" to the width "S" (see FIG. 5) of the mounting hole is from about 8:7 to about 10:7, and preferably is about 9:7. If the ratio is too small, not enough different types of baseball shoes can be accommodated; if the ratio is too large, the structure of the cleat is unduly weakened.

The mounting hole 32 comprises a central rectangular section 32*a* and two end radiused sections 32*b*.

Unlike conventional cleats/baseball shoes configurations, the surface area of the base 22 of the cleat is generally smaller than the surface area of the respective recess so that in the absence of the retaining fastener, the cleat wiggles in the recess. For example, the surface area of the cleat can be from 85 to 95% of the surface area of the recess. This is a result of designing a universal cleat.

The materials used to construct the cleat 10 are the type typically used for such cleats. More particularly, in the version of the invention of FIG. 1, a metal insert 34 provides reinforcement in the critical stress area, i.e., where the fastener holds the cleat against the shoe sole. Preferably the metal used is cold rolled steel that is chromate treated. The rest of the cleat is molded from a durable rigid polymeric material, such as nylon PA 6-6 available from DuPont.

Figure 12:
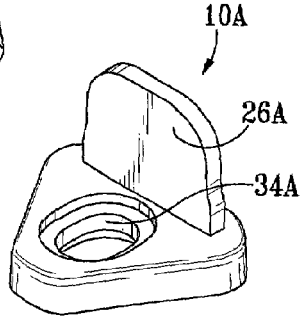
FIG. 12 is a perspective view of another version of a cleat according to the present invention.

In an alternate version of a cleat 10A of the invention shown in FIG. 12, the insert 34A and grip 26A are a single metallic piece, providing a stronger gripping portion of the cleat. The metal can be cold rolled steel that is chromate treated.

Preferably, baseball shoes are fitted out totally with cleats of the present invention. However, it is recognized that since for the most part the cleats of the present invention are used as replacement cleats, and there are occasions when only some of the cleats are replaced. Thus, conventional cleats and the cleats of the present invention can be used on a single athletic shoe.

Figure 7:
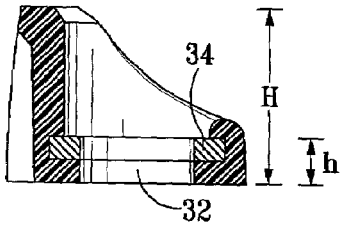
FIG. 7 is a sectional view of the cleat of FIG. 1 taken on line 7-7 in FIG. 3.

Exemplary of the dimensions of a cleat of the present invention is a height of about 14 millimeters from the top of the grip to the bottom of the base 22, with the base 22 having a height "h" of about 5 millimeters (see FIG. 7).

Although the present invention has been described in considerable detail with reference to certain preferred versions thereof, other versions are possible. Therefore, the scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Also, any element in a claim that does not explicitly state "means for" performing a specified function or "step for" performing a specified function, should not be interpreted as a "means" or "step" clause as specified in 35 U.S.C. §112.

What is claimed is:

1. A universal cleat suitable for use with a plurality of different athletic shoes, each different shoe having uniquely shaped generally triangular recesses in the sole each for receiving a cleat, each recess having a threaded opening therein for receiving a retaining screw to hold a cleat in place and each recess having a recess perimeter, the cleat comprising:

(a) a generally triangular base having two straight sides of equal length with a substantially flat bottom, the dimensions of the substantially flat bottom being sized to fit within each uniquely shaped recess perimeter, vertices of said triangular base being rounded;

(b) a grip projecting substantially perpendicularly from the base;

(c) an oblong shaped mounting hole recessed within the base for receiving the retaining screw; and (d) a metal insert positioned inside the base around the oblong shaped mounting hole, wherein the area of the base is smaller than the areas of each of the recesses so that in the absence of the retaining fastener a cleat can wiggle in a recess, and wherein the ratio of a length of the mounting hole to a width of the mounting hole is from about 8:7 to about 10:7.

2. The cleat of claim 1 wherein the area of the base is from 85 to 95% of the area of the recess.

3. The shoe of claim 2 wherein all of the cleats are universal cleats.

4. An athletic shoe comprising:

a sole;

multiple recesses in the sole sized for receiving a cleat;

a threaded opening in each recess;

cleats mounted in at least some of the recesses, at least one cleat being a universal cleat comprising (i) a generally triangular base with a substantially flat bottom, the dimensions of the substantially flat bottom being sized to fit within a plurality of differently shaped recess perimeters, (ii) a grip projecting from the base in a plane substantially perpendicular to the plane of the base, and (iii) a mounting hole in the base, at least one of the mounting holes being oblong shaped;

a retaining fastener for each cleat extending through the mounting hole and threaded into the respective threaded opening for retaining the respective cleat in place; and a metal insert positioned inside the base around the oblong shaped mounting hole, wherein the area of the base of each universal cleat is smaller than the area of the respective recess so that in the absence of the retaining fastener, the cleat wiggles in the recess, and wherein the ratio of the length of each oblong shaped mounting hole to the width of the oblong shaped mounting hole is from about 8:7 to about 10:7.

5. The shoe of claim 4 wherein the area of the base is from 85 to 95% of the area of the recess.

6. A universal cleat usable in any one of a plurality of athletic shoes, all of said shoes sharing the common characteristic of the bottom of each shoe of said plurality having at least one generally triangularly configured cleat mounting surface with a recess for receiving said cleat with a threaded receptacle positioned within said recess for receiving a retaining screw to hold the cleat in place, said cleat comprising:

(a) a generally triangular base having a bottom planar surface adapted for facing contact with said recess of said cleat mounting surfaces of said shoes of said plurality;

(b) a grip projecting perpendicularly from the base in a direction oppositely from that of a plane defined by the base planar surface portion;

(c) an oblong aperture in the planar portion of said base for passage therethrough of said retaining screw; and (d) a metal insert positioned inside the base around the oblong aperture.

7. The cleat of claim 6 wherein the area of said base is smaller than the smallest area of the recess of any of the shoes of said plurality so that in the absence of the retaining fastener, the cleat may wiggle within the recess.

8. The cleat of claim 6 wherein the ratio of length to width of the oblong aperture is from about eight to seven (8:7) to about ten to seven (10:7).

* * * * *